US007892105B2

(12) United States Patent
Galloway

(10) Patent No.: US 7,892,105 B2
(45) Date of Patent: Feb. 22, 2011

(54) CONNECTION ASSEMBLY FOR A GOLF CLUB

(75) Inventor: J. Andrew Galloway, Escondido, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 12/691,517

(22) Filed: Jan. 21, 2010

(65) Prior Publication Data

US 2010/0120550 A1 May 13, 2010

Related U.S. Application Data

(63) Continuation-in-part of application No. 12/046,597, filed on Mar. 12, 2008, now abandoned.

(60) Provisional application No. 60/894,415, filed on Mar. 12, 2007.

(51) Int. Cl.
*A63B 53/02* (2006.01)

(52) U.S. Cl. ..... 473/288; 473/307; 473/309

(58) Field of Classification Search ..... 473/307, 473/309, 294, 296, 288, 298–299; 403/321, 403/348, 352, 365, DIG. 4, DIG. 7
See application file for complete search history.

(56) References Cited

U.S. PATENT DOCUMENTS

| | | | |
|---|---|---|---|
| 1,454,267 | A | 5/1923 | Challis et al. |
| 2,067,556 | A | 1/1937 | Wettlaufer |
| 2,171,483 | A | 8/1939 | Simonton |
| 3,524,646 | A | 8/1970 | Wheeler |
| 4,664,382 | A | 5/1987 | Palmer et al. |
| 4,943,059 | A | 7/1990 | Morell |
| 4,948,132 | A | 8/1990 | Wharton |
| 5,513,844 | A | 5/1996 | Ashcraft et al. |
| 5,588,921 | A | 12/1996 | Parsick |
| 5,702,310 | A | 12/1997 | Wozny |
| 5,951,411 | A | 9/1999 | Wood et al. |
| 6,416,415 | B1 | 7/2002 | Yu |
| 6,769,994 | B2 | 8/2004 | Boone |
| 6,890,269 | B2 | 5/2005 | Burrows |
| 6,896,626 | B2 | 5/2005 | Drossos |
| 7,083,529 | B2 | 8/2006 | Cackett et al. |
| 2001/0007835 | A1 | 7/2001 | Baron |
| 2002/0037773 | A1 | 3/2002 | Wood et al. |
| 2004/0018887 | A1 | 1/2004 | Burrows |
| 2005/0049072 | A1 | 3/2005 | Burrows |
| 2007/0117645 | A1 | 5/2007 | Nakashima |

*Primary Examiner*—Stephen L. Blau
(74) *Attorney, Agent, or Firm*—Michael A. Catania

(57) ABSTRACT

A golf club including a club head and an interchangeable shaft is disclosed herein. A connection assembly (44) comprises a sleeve insert (47), a hosel sleeve (48), a hosel tube (46), a ring mechanism (48) and a guide ring (49).

1 Claim, 5 Drawing Sheets

FIG. 1
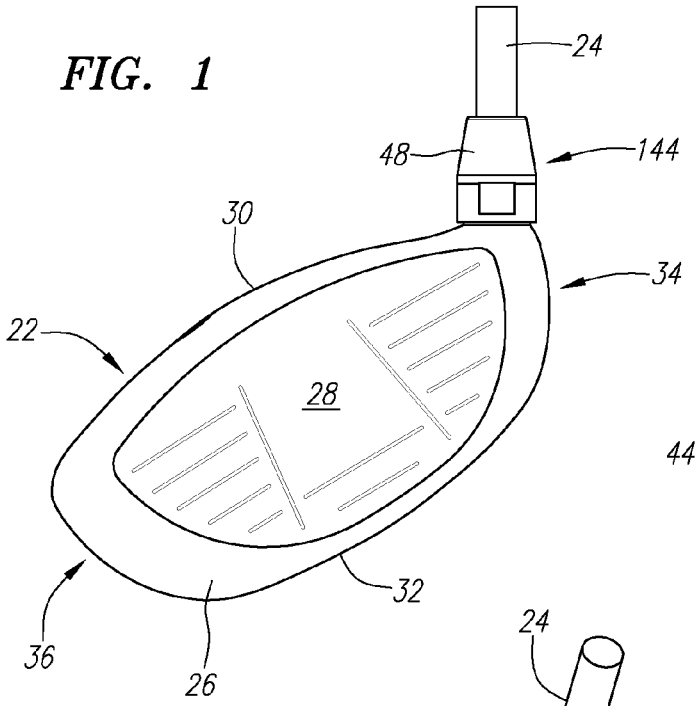
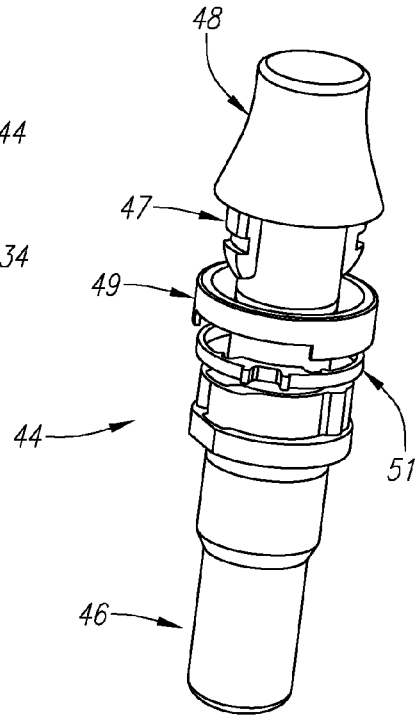
FIG. 2A
FIG. 2
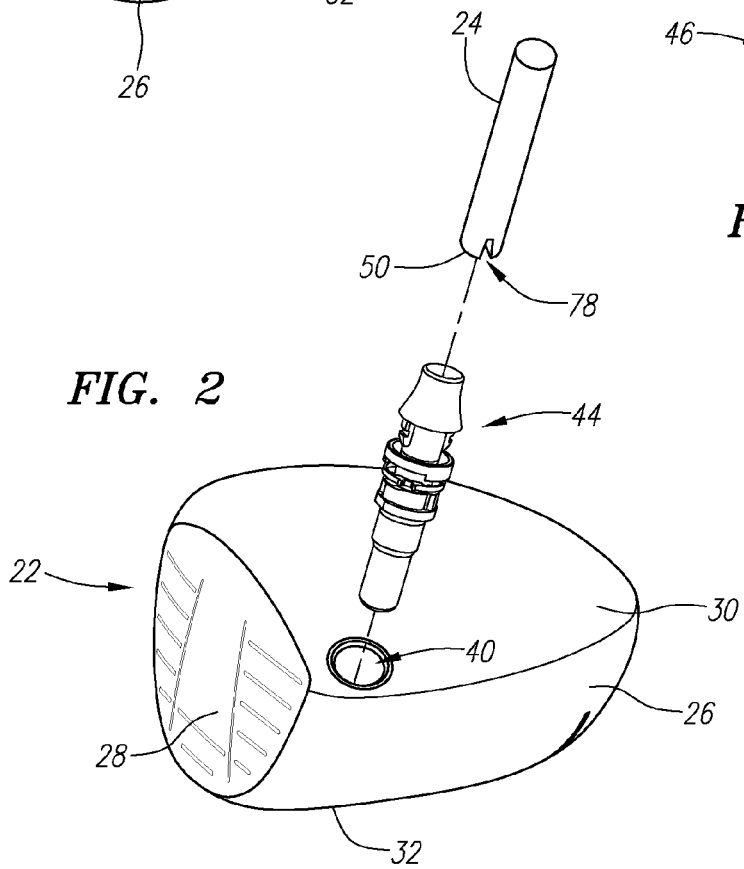

| | Golf Club 20 with Connection 44 | Standard Golf Club Same Shaft and Club Head as Golf Club 20 |
|---|---|---|
| Mass (g) | 207.763848 | 207.263143 |
| Head Frame | | |
| CgX (in.) | 0.549019 | 0.550348 |
| CgY (in.) | 0.582579 | 0.596520 |
| CgZ (in.) | 1.169533 | 1.153910 |
| Ixx ($g.cm^2$) | 3227.178871 | 3169.285141 |
| Iyy ($g.cm^2$) | 2462.574837 | 2452.436507 |
| Izz ($g.cm^2$) | 4283.389553 | 4232.627803 |
| Iyz ($g.cm^2$) | 37.401192 | 71.447669 |
| Ixz ($g.cm^2$) | -92.997138 | -81.512224 |
| Ixy ($g.cm^2$) | 378.826981 | 368.571564 |
| Hosel Frame | | |
| CgX (in.) | -1.534762 | -1.555509 |
| CgY (in.) | 1.136975 | 1.139796 |
| CgZ (in.) | -0.549019 | -0.550348 |
| Ixx ($g.cm^2$) | 3748.704575 | 3742.212978 |
| Iyy ($g.cm^2$) | 2997.259815 | 2942.851331 |
| Izz ($g.cm^2$) | 3227.178871 | 3169.285141 |
| Iyz ($g.cm^2$) | -262.058461 | -259.978618 |
| Ixz ($g.cm^2$) | 288.935481 | 273.679299 |
| Ixy ($g.cm^2$) | -830.104270 | -798.517546 |
| Face Frame | | |
| CgX (in.) | 1.145370 | 1.149918 |
| CgY (in.) | -0.169563 | -0.155622 |
| CgZ (in.) | 0.189240 | 0.174235 |

*FIG. 9*

CONNECTION ASSEMBLY FOR A GOLF CLUB

CROSS REFERENCE TO RELATED APPLICATIONS

The Present Application is a continuation-in-part application of U.S. patent application Ser. No. 12/046,597 filed on Mar. 12, 2008 now abandoned, which claims priority to U.S. Provisional Patent Application No. 60/894,415, filed on Mar. 12, 2007.

STATEMENT REGARDING FEDERALLY SPONSORED RESEARCH OR DEVELOPMENT

Not Applicable

BACKGROUND OF THE INVENTION

1. Field of the Invention

The present invention relates to a golf club having an improved connection for interchanging a shaft with a golf club head.

2. Description of the Related Art

In order to improve their game, golfers often customize their equipment to fit their particular swing. Golf equipment manufacturers have responded by increasing the variety of clubs available to golfers. For example, a particular model of a driver-type golf club may be offered in several different loft angles and lie angles to suit a particular golfer's needs. In addition, golfers can choose shafts, whether metal or graphite, and adjust the length of the shaft to suit their swing. Golf clubs that allow shaft and club head components to be easily interchanged facilitate this customization process.

One example is Wheeler, U.S. Pat. No. 3,524,646 for a Golf Club Assembly. The Wheeler patent discloses a putter having a grip and a putter head, both of which are detachable from a shaft. Fastening members, provided on the upper and lower ends of the shaft, have internal threads, which engage the external threads provided on both the lower end of the grip and the upper end of the putter head shank to secure these components to the shaft. The lower portion of the shaft further includes a flange, which contacts the upper end of the putter head shank, when the putter head is coupled to the shaft.

Another example is Walker, U.S. Pat. No. 5,433,442 for Golf Clubs with Quick Release Heads. The Walker patent discloses a golf club in which the club head is secured to the shaft by a coupling rod and a quick release pin. The upper end of the coupling rod has external threads that and engage the internal threads formed in the lower portion of the shaft. The lower end of the coupling rod, which is inserted into the hosel of the club head, has diametric apertures that align with diametric apertures in the hosel to receive the quick release pin.

Still another example is Roark, U.S. Pat. No. 6,547,673 for an Interchangeable Golf Club Head and Adjustable Handle System. The Roark patent discloses a golf club with a quick release for detaching a club head from a shaft. The quick release is a two-piece connector including a lower connector, which is secured in the hosel of the club head, and an upper connector, which is secured in the lower portion of the shaft. The upper connector has a pin and a ball catch that protrude radially outward from the lower end of the upper connector. The upper end of the lower connector has a slot formed therein for receiving the upper connector pin, and a separate hole for receiving the ball catch. When the shaft is coupled to the club head, the lower connector hole retains the ball catch to secure the shaft to the club head.

U.S. Pat. No. 6,769,996 to Tseng discloses a Golf Club and a Method for Assembling the Golf Club. The golf club employs an externally threaded bolt to secure a shaft to the club head. The bolt, which is located inside the club head, extends through a threaded opening formed in a flange at a lower portion of the neck of the club head and engages a threaded lower end of the shaft. The bolt is accessed using a tool that is inserted in an opening formed in the sole of the club head. When the tool is extracted, the opening in the sole is plugged with a screw.

Two further examples are published applications to Burrows, U.S. Pub. Nos. 2004/0018886 and 2004/0018887, both of which are for a Temporary Golf Club Shaft-Component Connection. The Burrows applications disclose a temporary connection that includes an adapter insert, a socket member, and a mechanical fastener. The adapter insert, which is mounted on a shaft, includes a thrust flange. The socket member, which is mounted on the other golf club component (e.g., a club head), includes a thrust seat for seated reception of the thrust flange. The mechanical fastener (e.g., a compression nut or a lock bolt) removably interconnects the adapter insert and the socket member.

The prior art temporary head-shaft connections have several disadvantages. First, these connections typically add excessive weight to the club head, which affects the playability characteristics of the golf club. A change in the overall weight of a golf club alters the center of gravity and moments of inertias of the club head. Thus, a golf club with a shaft permanently affixed to a club head would have inherently different characteristics than a trial golf club that uses a prior art temporary connection to combine the same shaft and club head. Second, some of these connections require that the golf club head have a conventional hosel for attachment, while others require that a special head be made or that the club head be altered to accommodate the temporary connection. These changes can increase costs by requiring additional manpower, resources and inventory. Moreover, many of these prior art connections are cumbersome to use. Some designs require the connection device to be accessed from the bottom of the club head, others from the top, with different tools and procedures for each.

BRIEF SUMMARY OF THE INVENTION

The present invention provides an improved club head-shaft connection that temporarily couples standard, production golf club heads and shafts in a manner that does not adversely affect the playability of the resulting golf club. Because the quick sleeve and mechanical fastener connection is made of a strong engineered plastic, it is lightweight and does not add excessive weight, which would negatively impact the resulting golf club. The strong plastic material enables the present connection to oppose the high stresses that occur in the head-shaft connection during a club swing and upon impact with a golf ball. In addition, the present invention provides a consistent way of temporarily fixing a shaft to a club head, one that does not vary among different club head models. The present invention may further be applied to all wood-type golf clubs, including drivers and fairway woods.

The purpose of this invention is to enable easy installation of various shafts of interest into product-like heads to produce custom combinations of heads and shafts for trial by the golfing consumer.

Further, this invention seeks to minimize the meaningful mass, cost, appearance and structural differences between the bonded and otherwise assembled clubs and in the quick-fit shaft clubs.

Moreover, this invention seeks to achieve near complete similarity between the quick-fix shaft installations and the rapid-production installations. The one difference being that the rapid-production club quick assembly shafts can not be easily removed. The interfaces and load paths are nearly identical. This is accomplished by the detail design of the custom snap ring. This invention enables improvements in the process of shaft installation through rapid, reliable installation of shafts in production environments and in fitting environments.

The invention, as applied to drivers, utilizes the same hosel receiving details optimized by Callaway Golf and currently used in drivers and other "wood" clubs. Modifications to the invention can be used for iron club assembly. The hosel sleeve used by Callaway Golf to improve reliability is retained as is the overall elastic distribution of the interface. The invention configuration also allows the current and anticipated combinations of non-bore through and bore-through hosels.

In this invention, the hosel sleeve is modified by integrally molding a metal ring about the hosel sleeve. This hosel sleeve ring is a modified cylindrical shell that bonds structurally to the hosel sleeve. The modified hosel sleeve is routinely and conventionally bonded to the shaft. The hosel sleeve ring incorporates two or more horizontal slots to provide retention of the shaft/sleeve subassembly into the hosel tube. The tubes have blunt ends.

The hosel tube, molded, welded, or otherwise installed into the club head is modified to increase local diameter where the hosel sleeve ring resides when installed. Additional modifications add a detailed groove and coincident receiving slots to complete the retention of the shaft and hosel subassembly. The slots in the club head hosel tube coordinate with the receiving slots in the shaft sleeve. A near circular ring includes the details that simultaneously fill the horizontal slots in both the club head hosel and the shaft subassembly. The features fix the shaft to the head against movement along the shaft axis, To install the shaft hosel sleeve subassembly, the near circular ring must be rotated 10° to misalign the retention features tabs including the retaining shaft.

Additional features in the modified hosel sleeve react rotations about the shaft axis. These features are interruptions of the interface plane, perpendicular to the shaft axis. The shaft is thus fixed to the head in proper alignment and location by these features.

To interchange shafts in individual heads, the near circular clip includes specific indentations and or other features that match a specific tool pattern as in a common key, only in a semi circular pattern. This keyed tool when installed about the snap ring transfers torque to the snap ring to a rotate the tabs out of the indexed slots in the hosel sleeve ring to release the shaft. The invention releases the shaft after 45 degrees of rotation via a cam feature design into the details of the ring and hosel groove geometry. The ring includes tabs with a slight pitch angle such that the shaft assembly is drawn down to the head.

To enable rapid-production installation of the shaft, the hosel sleeve ring includes a ramp feature that pushes the snap ring open when a shaft subassembly is pushed into the club head. When the shaft subassembly reaches the intended location the spring clip tension pushes the retention features into the receiving slots to complete the installation. This applies to quick-fit and rapid-production assemblies. The production assemblies would utilize snap rings that can not be easily removed via a smooth outer surface of the modified hosel sleeve so that no force can readily be applied to open the snap ring.

Shaft retention is accomplished by using two or more keyed slots perpendicular to the shaft axis to prevent removal of the shaft and two or more keyed disruptions perpendicular to the hosel sleeve and shaft axis to react rotation of the shaft in the club head.

A novel feature of the present invention is a near circular custom snap ring forces integral tabs into perpendicular slots to achieve the installation and retention of the shaft.

Another novel feature of the present invention is the ability to create either a rapid-fit, temporary shaft installation or a rapid-production, near permanent joint by changes in the snap ring outer surface.

Yet another novel feature of the present invention is the ability to open the joint by rotation of the snap.

Yet another novel feature of the present invention is the requirement of a specific keyed tool to limit the opportunities to remove and replace the shafts.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 1 is a front plan view of a golf club in accordance with the present invention.

FIG. 2 is an exploded heel perspective view of the golf club of FIG. 1 illustrating the components of the connection assembly, including a hosel sleeve, a guide ring, a hosel tube, a ring, and a hosel insert.

FIG. 2A is an isolated view of a connection assembly.

FIG. 9 is a table comparing the mass properties of a golf club of the present invention and a standard production golf club.

DETAILED DESCRIPTION OF THE INVENTION

Figure 2B:
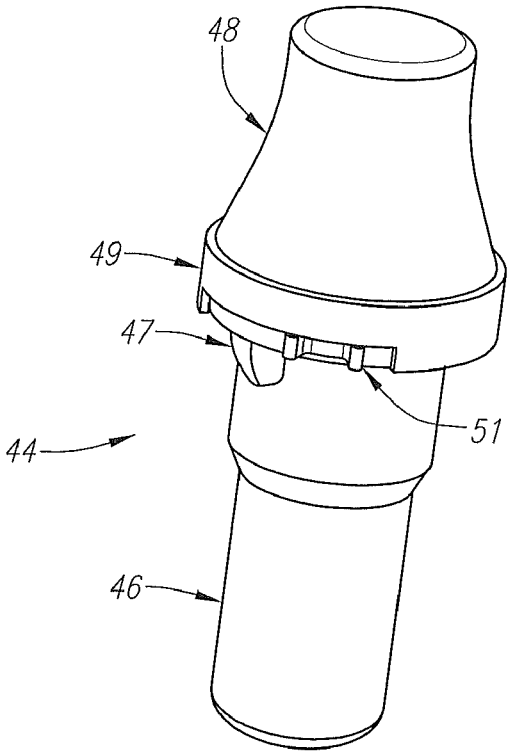
FIG. 2B is an isolated view of an assembled connection assembly with a hosel sleeve having a sleeve insert attached thereto engaging a hosel tube, guide ring and ring mechanism.

As shown in FIGS. 1 and 2, a golf club is generally designated 20. Golf club 20 has a club head 22 and a shaft 24 that is coupled to club head 22. Club head 22 is preferably a wood-type golf club head, such as a driver, a fairway wood, or even a hybrid iron-wood-type club. Club head 22 includes a body 26 having a striking face 28, a crown portion 30, a sole portion 32, a heel end 34 and a toe end 36. Striking face 28 generally extends along the front of club head 22 from heel end 34 to toe end 36.

Figure 3:
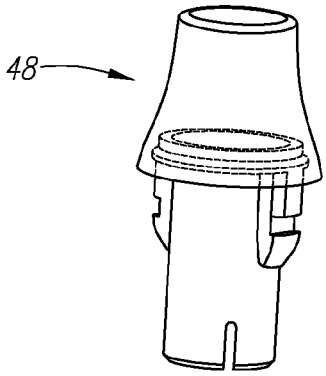
FIG. 3 is an isolated view of a hosel sleeve with a sleeve insert threadingly attached thereto.
Figure 4:
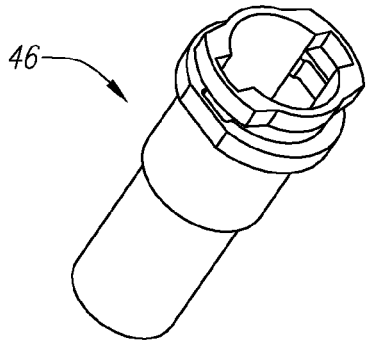
FIG. 4 is an isolated view of a hosel tube.
Figure 5:
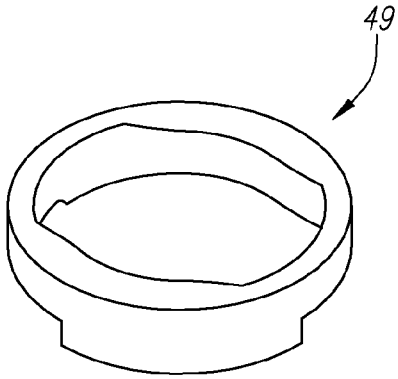
FIG. 5 is an isolated view of a guide ring.
Figure 6:
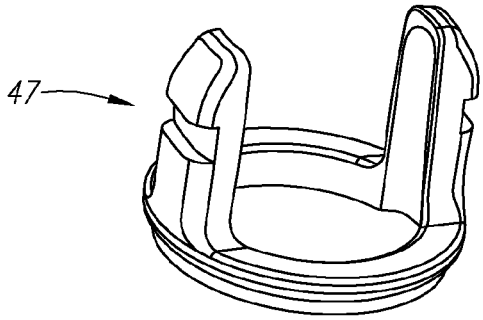
FIG. 6 is an isolated view of a sleeve insert.
Figure 7:
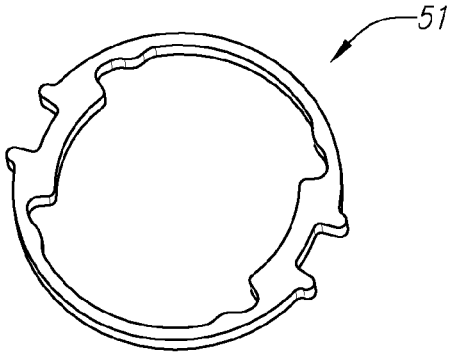
FIG. 7 is an isolated view of a ring mechanism.

Body 26 is preferably composed of a metallic material, such as titanium, titanium alloy, stainless steel, or the like. Alternatively, body 26 may be composed of multiple materials, such as a titanium face cup attached to a carbon composite body, or a stainless steel body with a carbon composite crown. Body 26 preferably has a hollow interior and includes an internal hosel 38 (FIG. 3) for receiving shaft 24. Internal hosel 38 preferably extends through the entire body 26 with an opening 40 in crown portion 30 and an opening 42 in sole portion 32. Alternatively, internal hosel 38 need not extend through sole portion 32 and, therefore, may not have opening 42 in sole portion 32. Furthermore, club head 22 may be provided with an external hosel (not shown) rather than an internal one.

Shaft 24 is preferably composed of a graphite material, however, it may be composed of a metallic material, such as stainless steel or titanium. Alternatively, shaft 24 may be composed of a hybrid of graphite and metal. Shaft 24 is coupled to club head 22 using a connection assembly 44 that provides for easy assembly, disassembly and reassembly, thereby facilitating customization of golf club 20.

The connection assembly 44 preferably comprises a hosel tube 46, a sleeve insert 47, a hosel sleeve 48, a ring mechanism 51 and a guide ring 49.

The dimensions of the hosel sleeve 48 may vary depending on the particular club head 22, however, one such hosel sleeve 48 preferably has an overall length L of approximately 2.30 inches, with an upper portion length $L_{UP}$ of approximately 0.85 inch and a lower portion length $L_{LP}$ of approximately 1.45 inches.

Figure 2C:
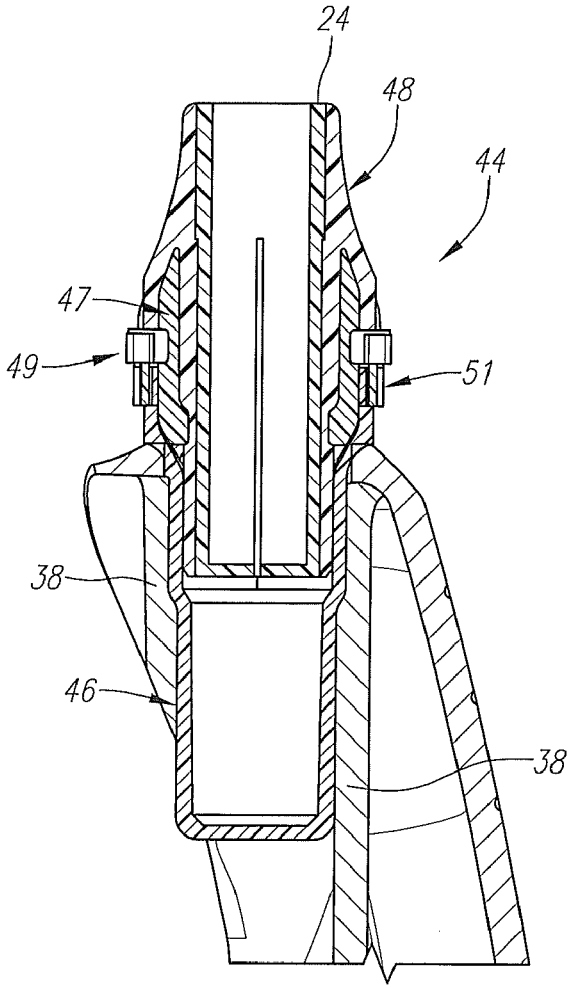
FIG. 2C is an isolated cross-sectional view of the connection assembly within a golf club head.

The golf club 20 is preferably assembled by inserting hosel tube 46 into internal hosel 38 of club head 22. A lower portion of the hosel tube 46 is preferably secured to the internal hosel 38 using an adhesive, such as an epoxy. A notch 78 is preferably formed in a tip end 50 of shaft 24. The notch 78 preferably has depth and width dimensions sufficient to accommodate the height and width of a rib in the hosel tube sleeve 46. The hosel sleeve 48 is preferably is placed over the tip end 50 of the shaft 24. As shown in FIGS. 2A, 2B and 2C, the ring mechanism 51 is positioned on the hosel tube 46 and the guide ring 49 maintains the ring mechanism 51 on the top of the hosel tube 46. The hosel sleeve 48 with the sleeve insert 47 threadingly engaged thereto is attached to the tip end 50 of a shaft 24. The attached hosel sleeve 48 is positioned within the hosel tube 46 and rotated to so that the sleeve insert 47 engages the ring mechanism 51 to securely connect the shaft 24 to the club head 22.

Figure 8:
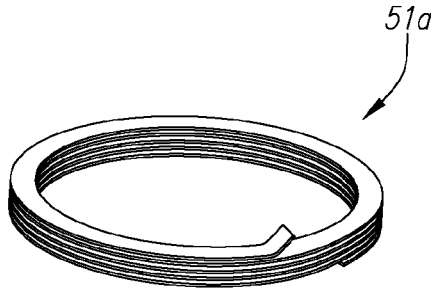
FIG. 8 is an isolated view of an alternative embodiment of a ring mechanism.
Figure 10:
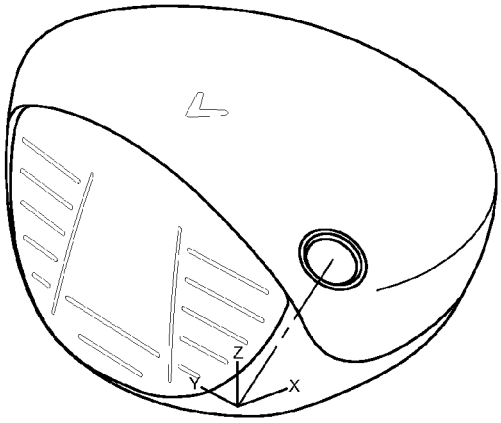
FIG. 10 is a front perspective view of a golf club illustrating the origin and the X, Y and Z-axes for head frame measurements.
Figure 11:
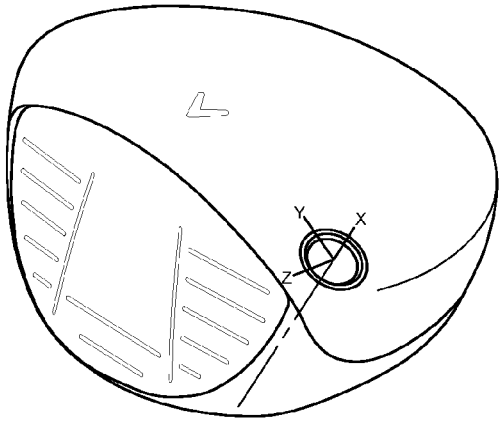
FIG. 11 is a front perspective view of a golf club illustrating the origin and the X, Y and Z-axes for hosel frame measurements.

The hosel tube 46 and the hosel sleeve 48 are each preferably composed of a strong, lightweight plastic material, such as a polycarbonate or urethane material. The plastic material may be impregnated with fiberglass or carbon fibers for increased strength. For example, the hosel tube 46 and the hosel sleeve 48 may be composed of a twenty percent glass-filled polycarbonate plastic. The combined weight of the hosel tube 46 and the hosel sleeve 48 and the mechanical fastener 48 connection is preferably in the range of 1 gram to 7 grams, more preferably between 2 grams and 5 grams, and most preferably approximately 2.8 grams. Alternatively, the hosel tube 46 is composed of MIM or LIQUID METAL™ metal. The guide ring 49 is preferably composed of an injection molded plastic. The ring mechanism 51 or 51 a (shown in FIG. 8) is preferably composed of MIM 17-4 or cast LIQUID METAL™ metal. The sleeve insert 47 is preferably composed of MIM 17-4 or cast LIQUID METAL™ metal.

Figure 12:
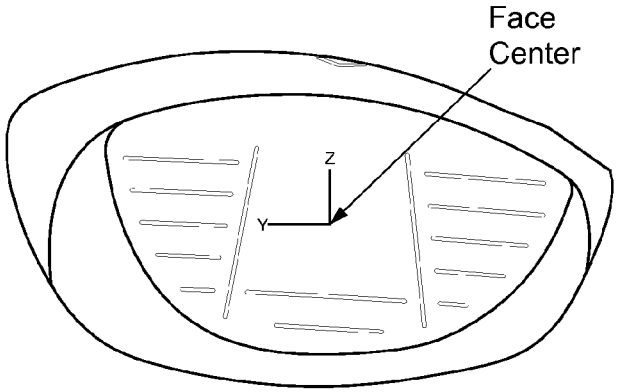
FIG. 12 is a front plan view of a golf club illustrating the origin and the Y and Z-axes for face frame measurements.
Figure 13:
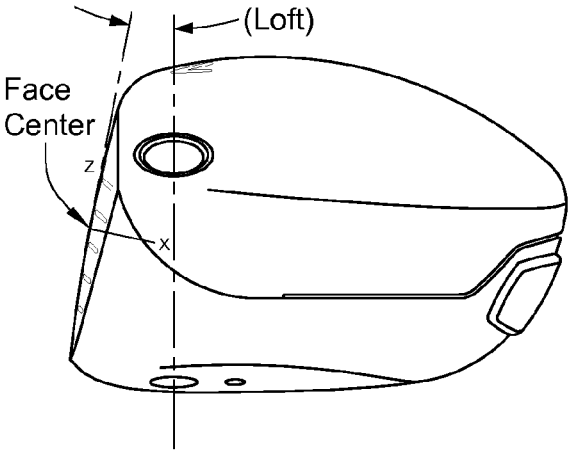
FIG. 13 is a heel plan view of the golf club illustrating the origin and the X and Y-axes for face frame measurements.
Figure 14:
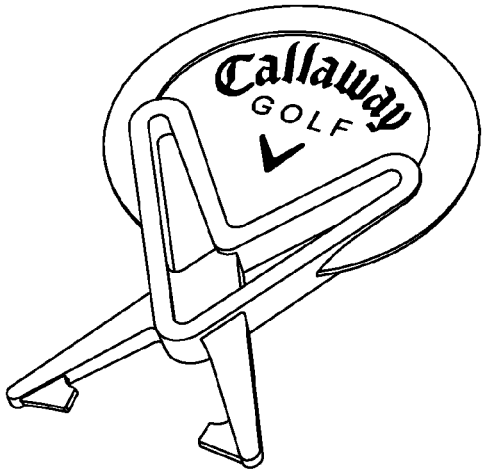
FIG. 14 is an isolated view of a tool used with the connection assembly.

The golf club of the present invention provides a temporary club head and shaft combination that has similar golf club characteristics to a standard production model of the same club head and shaft. The table provided in FIG. 9 compares the mass properties between a 10° driver with a shaft temporarily connected using connection assembly 44 of the present invention and an identical 10° driver with an identical shaft permanently affixed in the internal hosel of a club head. FIGS. 10-13 illustrate the origin and axes used for the head frame, hosel frame and face frame measurements, respectively. The origin is located at the intersection of the hosel's central axis and the ground plane for the head frame (FIG. 10), at the top the hosel's central axis for the hosel frame (FIG. 11), and at the face center of the club head for the face frame (FIGS. 12 and 13).

The table in FIG. 9 shows that the difference in mass between the two golf clubs is slight, approximately 0.5 gram. In addition, the center of gravity location and the moments of inertia about each of the X, Y and Z-axes for the two golf clubs are very close. The similarities between the two golf clubs may be attributed to the lightweight plastic material that comprises connection 44 as well as to the sleeve design, which prevents shaft 24 from fully extending into internal hosel 38. Because only approximately 0.5 inch of shaft 24 extends into internal hosel 38, the mass of the resulting golf club 20 is about the same as the identical club head and shaft combination with the shaft fully inserted in and permanently attached to the hosel of the club head. The golf club of the present invention allows golfers to accurately test various club head and shaft combinations, since connection 44 does not adversely alter the playability of the golf club. Thus, golfers who swing golf club 20 will get an accurate feel of how a standard production golf club of that club head and shaft combination would play.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A wood-type golf club comprising:

a club head including a striking face, a crown portion, a sole portion, a heel end, a toe end, and an internal hosel having a first opening in the crown portion;

a shaft having a tip end;

a connection assembly for removably connecting the shaft to the club head, the connection assembly comprising a hosel sleeve fixed to the tip end of the shaft, a hosel tube connected to the internal hosel of the club head, a sleeve insert engaging the hosel sleeve and the hosel tube, a ring mechanism and a guide ring, wherein the hosel sleeve is composed of an urethane, the hosel tube is composed of an amorphous metal, the sleeve insert is composed of an amorphous metal, the ring mechanism is composed of an amorphous metal and the guide ring is composed of an injection molded plastic.

* * * * *